US009004472B2

(12) United States Patent
Schmidt

(10) Patent No.: US 9,004,472 B2
(45) Date of Patent: Apr. 14, 2015

(54) FIVE AXIS MACHINE VISE

(75) Inventor: David L. Schmidt, Zimmerman, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 716 days.

(21) Appl. No.: 13/210,515

(22) Filed: Aug. 16, 2011

(65) Prior Publication Data

US 2012/0043711 A1 Feb. 23, 2012

Related U.S. Application Data

(60) Provisional application No. 61/374,656, filed on Aug. 18, 2010.

(51) Int. Cl.
*B25B 1/10* (2006.01)
*B25B 1/24* (2006.01)

(52) U.S. Cl.
CPC ..... *B25B 1/103* (2013.01); *B25B 1/2473* (2013.01); *B25B 1/2484* (2013.01); *B25B 1/2468* (2013.01)

(58) Field of Classification Search
USPC ..... 29/244–282; 269/43
See application file for complete search history.

(56) References Cited

U.S. PATENT DOCUMENTS

| | | | | | |
|---|---|---|---|---|---|
| 1,406,981 | A | | 2/1922 | Cumner | |
| 1,811,299 | A | * | 6/1931 | Brockhaus, Jr. | 269/242 |
| 2,274,428 | A | * | 2/1942 | Odin | 269/138 |
| 2,564,138 | A | * | 8/1951 | Walker | 269/138 |
| 2,570,857 | A | * | 10/1951 | Purpura | 269/138 |
| 3,397,880 | A | * | 8/1968 | Kuban | 269/240 |
| 4,043,547 | A | * | 8/1977 | Glomb et al. | 269/136 |
| 4,098,500 | A | * | 7/1978 | Lenz | 269/136 |
| 4,192,521 | A | * | 3/1980 | Smith | 279/112 |

(Continued)

FOREIGN PATENT DOCUMENTS

| | | |
|---|---|---|
| DE | 102006046863 | 4/2008 |
| EP | 1 787 756 | 11/2006 |
| JP | 2008264983 | 11/2008 |

OTHER PUBLICATIONS

5 Axis Vise Advertisement, Vischer & Bolli, AG, Dubendorf Switzerland, 2 pgs. Admitted Prior Art, Published Aug. 5, 2010.

(Continued)

*Primary Examiner* — Lee D Wilson
*Assistant Examiner* — Tyrone V Hall, Jr.
(74) *Attorney, Agent, or Firm* — Westman, Champlin & Koehler, P.A.; Steven M. Koehler

(57) ABSTRACT

A five axis vise includes two separated vise body portions that are supported on a machine tool table or other support that fixes the vise body portions in position. The vise body portions have jaws spaced up from the machine tool table sufficiently to permit machining five surfaces of a work piece held in the jaws. A vise screw is rotatably mounted in one of the vise body portions, and extends to the other vise body portion to actuate a movable jaw on the other vise body portion. The vise screw is threaded into a jaw nut that has a drive surface that engages and drives a driven surface on the movable jaw, with the drive and driven surfaces being inclined relative to the axis of force application to provide a downward force component on the movable jaw as it is tightened. The vise screw is an assembly of a threaded shank or shaft and a hub that is rotatably mounted in one of the body portions, with the threaded shank or shaft being locked in position in the hub.

17 Claims, 9 Drawing Sheets

(56) References Cited

U.S. PATENT DOCUMENTS

| | | | | | |
|---|---|---|---|---|---|
| 4,529,183 | A | * | 7/1985 | Krason et al. | 269/43 |
| 4,583,724 | A | * | 4/1986 | Huang | 269/88 |
| 4,685,663 | A | * | 8/1987 | Jorgensen | 269/244 |
| 4,898,371 | A | * | 2/1990 | Mills et al. | 269/136 |
| 4,958,818 | A | | 9/1990 | Buchter | |
| 5,121,908 | A | | 6/1992 | Shatkus et al. | |
| 5,497,982 | A | * | 3/1996 | Stoltz et al. | 269/71 |
| 6,164,635 | A | | 12/2000 | Chase et al. | |
| 7,134,650 | B2 | * | 11/2006 | Trudel et al. | 269/138 |
| 2008/0203637 | A1 | * | 8/2008 | Li et al. | 269/71 |
| 2010/0164158 | A1 | * | 7/2010 | Weissenborn | 269/101 |
| 2010/0164159 | A1 | * | 7/2010 | Wurthele | 269/242 |

OTHER PUBLICATIONS

5 Axis Machine Tool Vise Gressel AG, Aadorf, Switzerland, 2 pgs. Admitted Prior Art, Published Aug. 5, 2010.

* cited by examiner

FIVE AXIS MACHINE VISE

CROSS REFERENCE TO RELATED APPLICATION

This application refers to and claims priority to U.S. Provisional Patent Application Ser. No. 61/374,656, filed Aug. 18, 2010, the content of which is incorporated by reference.

BACKGROUND OF THE DISCLOSURE

This disclosure relates to a vise that will permit machining on several sides of a work piece and which has two spaced vise body portions rigidly held on a support, such as a machine tool table. A movable jaw on one of the vise body portions is actuated by a jaw nut acting on the movable jaw through angled mating surfaces to provide down pressure on the jaw as the part is clamped and to do so with minimum deflection of the vise portions.

In the work holding and vise industry, the term "five axis vise" refers to a vise that allows five-sided machining, such as five sides of a cube without removing the part from the vise. This means the part must be elevated from the machine bed or table sufficiently to provide for a horizontal spindle of a machine tool to extend below the bottom of the part to allow for full machining of the sides of the part.

Prior five axis vises have the jaws extending upward from the machine tool table or bed, with the vise screw also raised to provide clearance above the bed. Prior devices are difficult to keep clean and free of chips, and do not provide a vise which actuates the movable jaw through angled surfaces that create a down force on the movable jaw.

SUMMARY OF THE DISCLOSURE

The present disclosure relates to a five axis vise that has a pair of separated vise body portions, that are spaced apart and mounted on a support, such as a machine tool table. The vise bodies are secured in place as shown on a machine tool table using capscrews and T-nuts. A vise screw or tension link is mounted on a first of the vise body portions and extends to a second vise body portion to engage a movable jaw assembly. The vise body portions comprise clamping jaws that are spaced above the machine tool table a sufficient distance to permit machining on the sides of the work piece. The present disclosure has a movable jaw nut in which the tension link, comprising a threaded screw as shown, passes through the nut adjacent a top of the nut, and above an angled surface that mates with a second angled surface on the movable jaw. The movable jaw slides along rails on the second vise body portion, and as the screw is tightened, or tension in the tension link increases (in the case of a hydraulic actuator) the movable jaw will be brought into clamping engagement with a work piece and the angled engaging surfaces between the jaw nut and moveable jaw will also create a down pressure on the movable jaw to prevent substantial deflection. The prevention of deflection of the support for the jaws aids in precise machining.

As shown, one end of the vise screw that is formed as a tension link is mounted in a hub that has an internal thread to receive the screw. The hub will rotate in a bore in the first vise body portion, and the screw itself is locked in place in the hub with a lock screw that passes through a bore in the hub and threads into an interior bore in the end of the vise screw, so that the vise screw assembly is securely held in place.

The hub at the end of the vise screw provides a relatively large surface for supporting and guiding the screw as it is rotated, and suitable thrust washers and bearings are used to react the end thrust on the hub when the screw is tightened to clamp a work piece. The first vise body forms a fixed jaw.

DETAILED DESCRIPTION OF THE PREFERRED EMBODIMENTS

Figure 1:
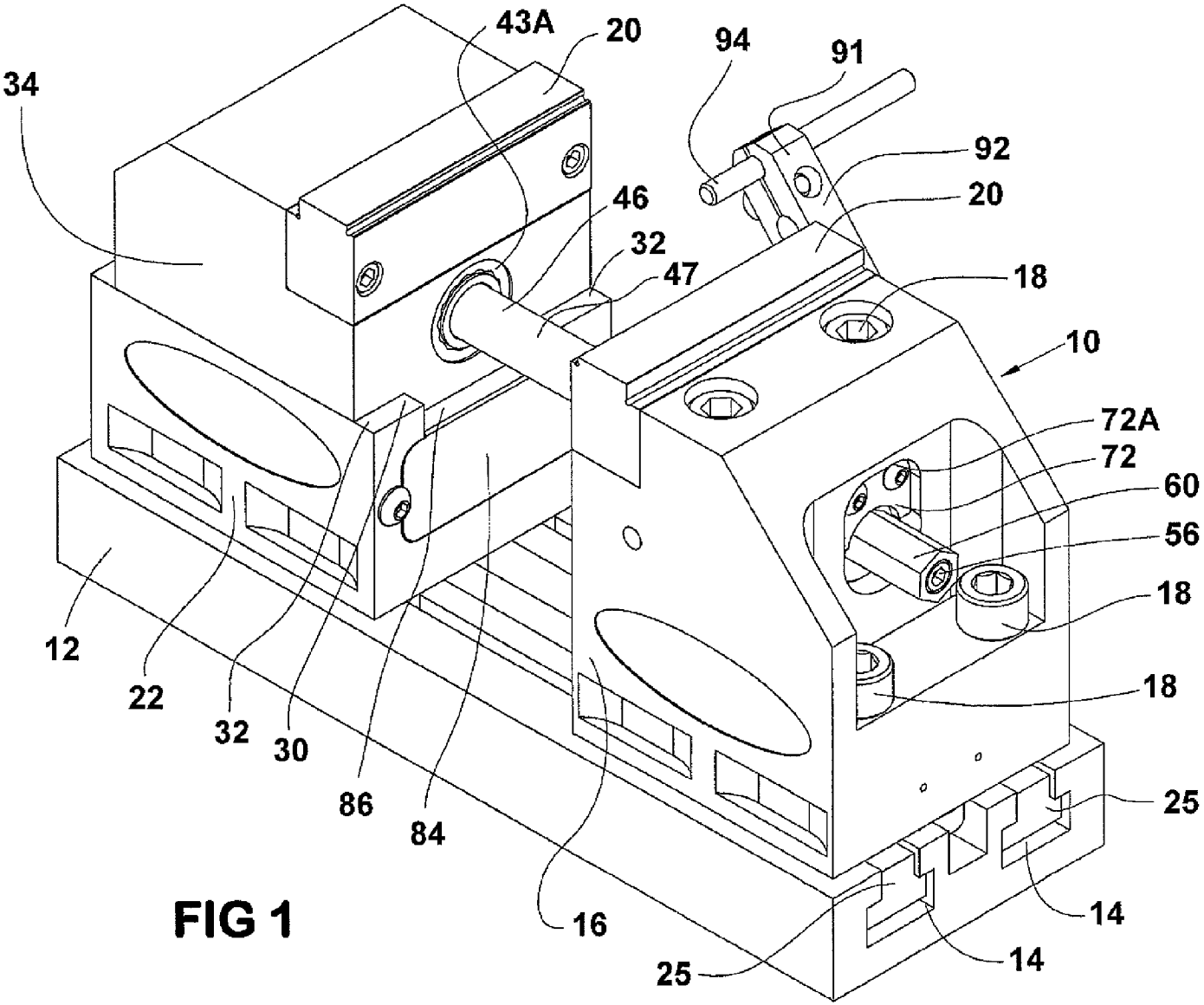
FIG. 1 is an isometric view of the vise assembly of the present disclosure showing two vise body portions in position to receive a part to be machined.
Figure 4:
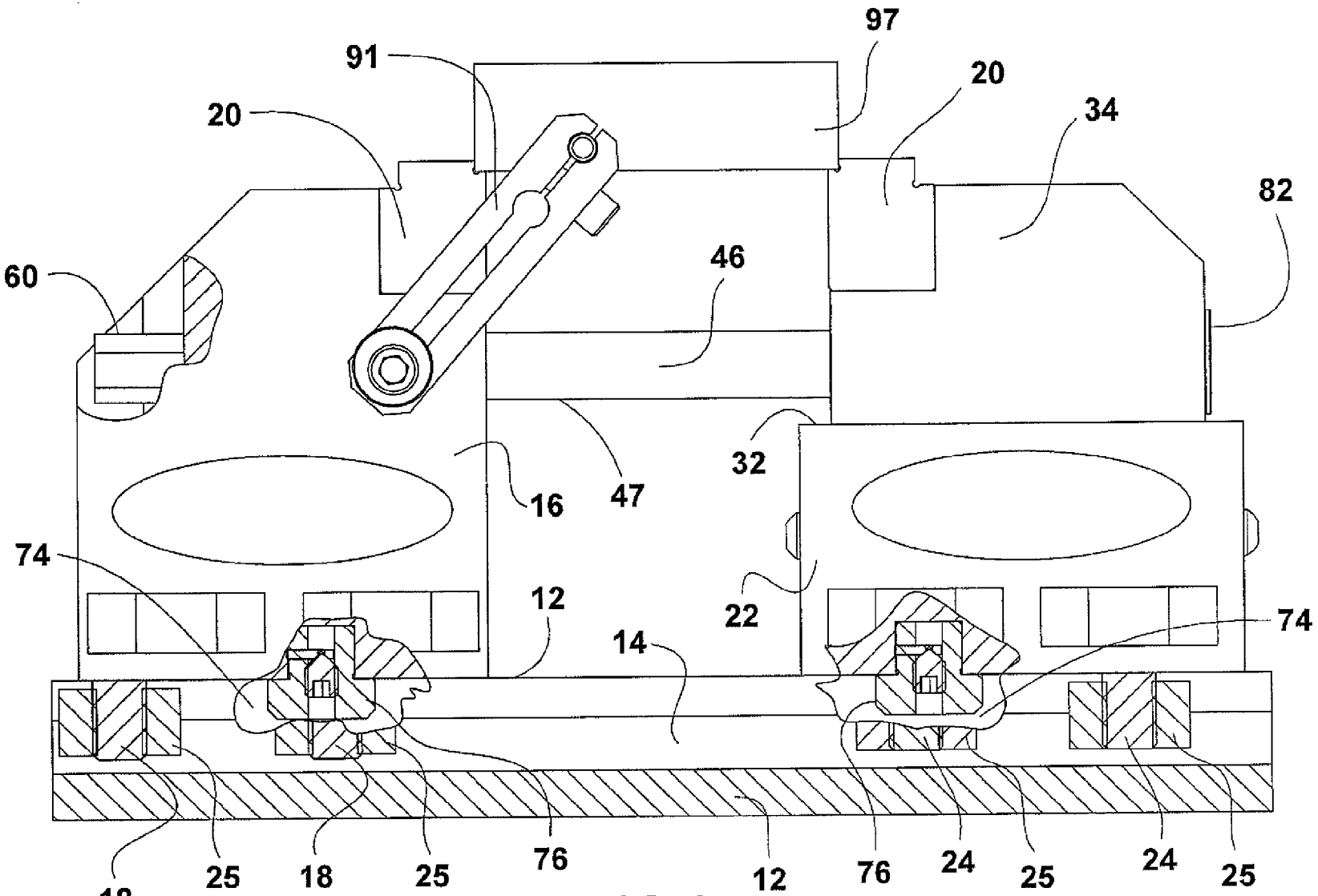
FIG. 4 is a side view of the vise assembly of FIG. 3.

FIG. 1, a five axis vise assembly indicated generally 10 is shown mounted on a support, schematically illustrated as a machine tool table 12. The vise assembly is mounted in the "T" slots 14 of such a machine tool table as is conventionally done. The vise assembly 10 includes a first fixed jaw vise body portion 16 that is fixed in position on the tool table 12 along the longitudinal direction of the T-slots 14 using suitable capscrews 18, and T-slot nuts 25 (FIG. 4). The fixed jaw vise body portion 16 has a jaw plate 20 at an upper corner thereof that faces a second movable jaw vise body portion 22, also held in place on the tool table 12 with cap screws 24 (see FIG. 4) and T slot nuts 25.

The vise body portions 16 and 22 can be held very securely, and as shown their facing surfaces are spaced apart. The vise body portion 22 is provided with a central longitudinal channel 26 that extends along the longitudinal length of the vise body portion 22, and is defined by upright side walls 28 (See FIG. 7) and overhanging lips 30 to provide spaced rails or upper support surfaces 32 on which a movable jaw 34 is slidably mounted. The movable jaw 34 includes a jaw plate 20, that is the same as the jaw plate 20 on the fixed vise body portion. The jaw plates can be changed for machining different types of parts as desired. The movable jaw 34 has an interior jaw nut chamber 36 (FIG. 6) defined therein, and open to a bottom surface of the movable jaw. A jaw nut 38 is slidably mounted in the channel 26 of the vise body portion 22, and as shown in FIG. 7 for example, the jaw nut 38 extends upwardly between the support surfaces 32 and is held from upward movement by the undersurfaces of the lips 30 that overhang portions of the channel 26. The jaw nut 38 has a head member 40 which extends into the nut chamber 36, and as shown in FIG. 6, the head member has an inclined downwardly facing drive surface 42 that mates against an upwardly inclined driven surface 44 formed on a forward wall of the movable jaw and extending laterally across the track chamber 36.

The movable jaw 34 also has a bore 43 formed therein through which a screw 46 or other tension carrying member can be passed and, as shown the screw 46 is threaded into a threaded through bore 49 of the head member 40 of the jaw nut 38. The jaw nut can be moved to travel along the screw 46 as the screw is rotated. A seal 43A is provided at the forward end of the bore 43.

The jaw nut 38 is held in place relative to the interior chamber 36 of the movable jaw 34 with a screw 48 (FIG. 6) providing a pressure to keep the inclined surface 42 on the jaw nut, and the surface 44 on the movable jaw adjacent to each other or in contact. It should be noted that the screw or tension carrying member 46 is positioned above the mating angled surfaces 42 and 44. The screw 46 is raised up from the top of table 12 a distance sufficient so a machine tool cutter can be positioned below a work piece 97 held in the jaws. Additionally, a stop screw 39 can be threaded through the jaw nut 38 so an end of the screw 39 rides in a slot 41 to limit the movement of the jaw nut 38.

Figure 2:
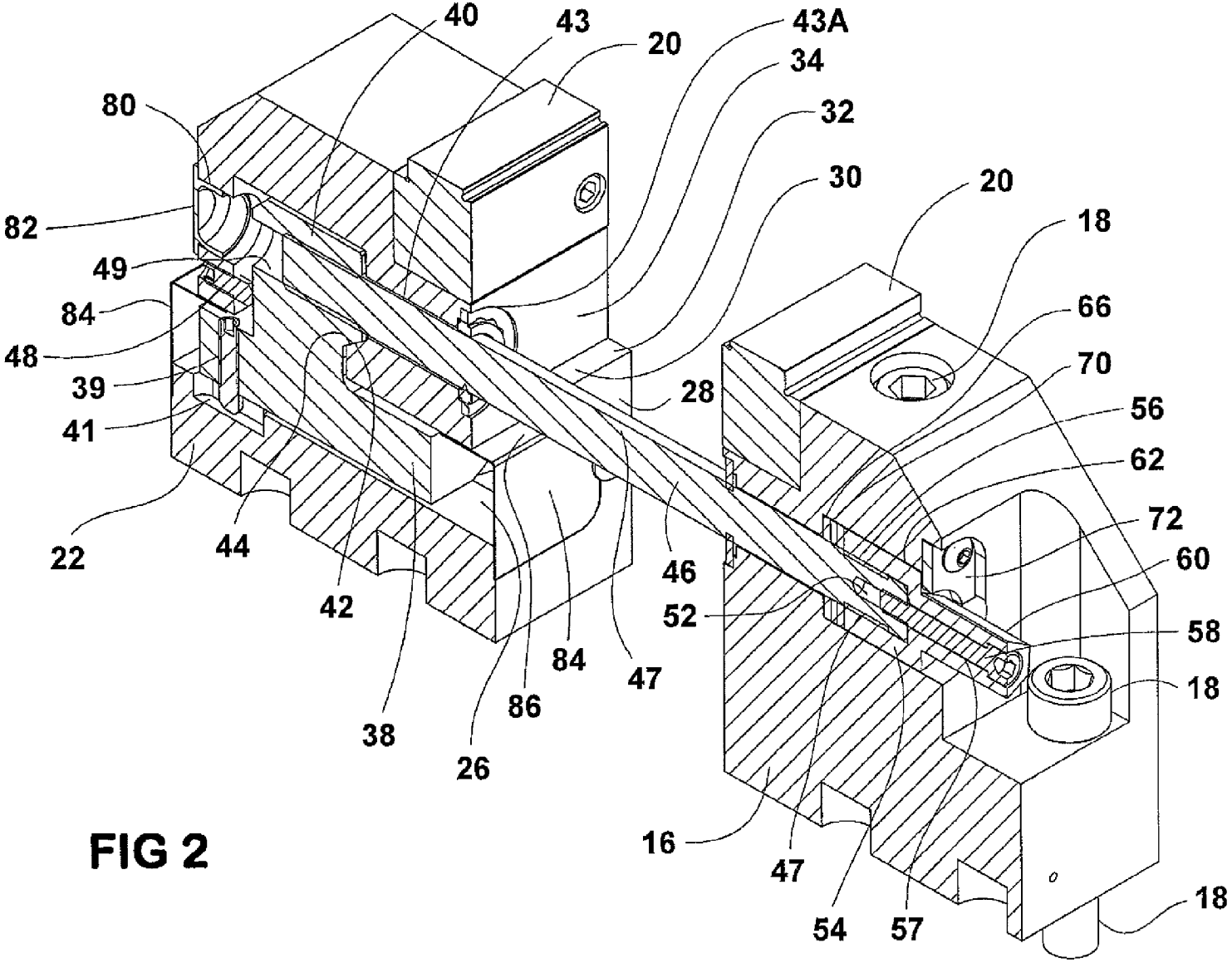
FIG. 2 is a view similar to FIG. 1 but sectioned along a longitudinal axis of the screw on a plane perpendicular to a support surface on which the vise assembly is retained.
Figure 3:
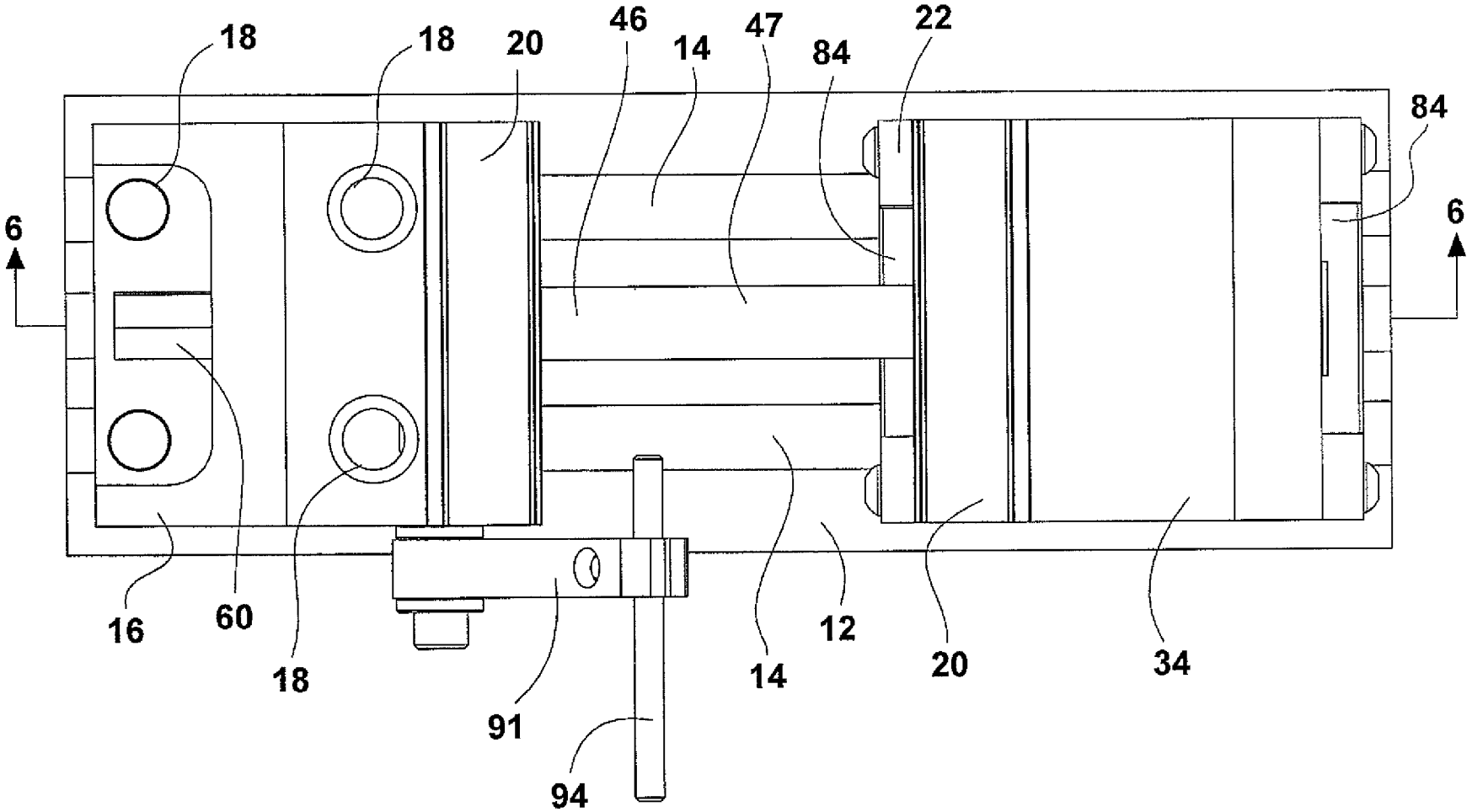
FIG. 3 is a top plan view of the vise assembly of FIG. 1.
Figure 6:
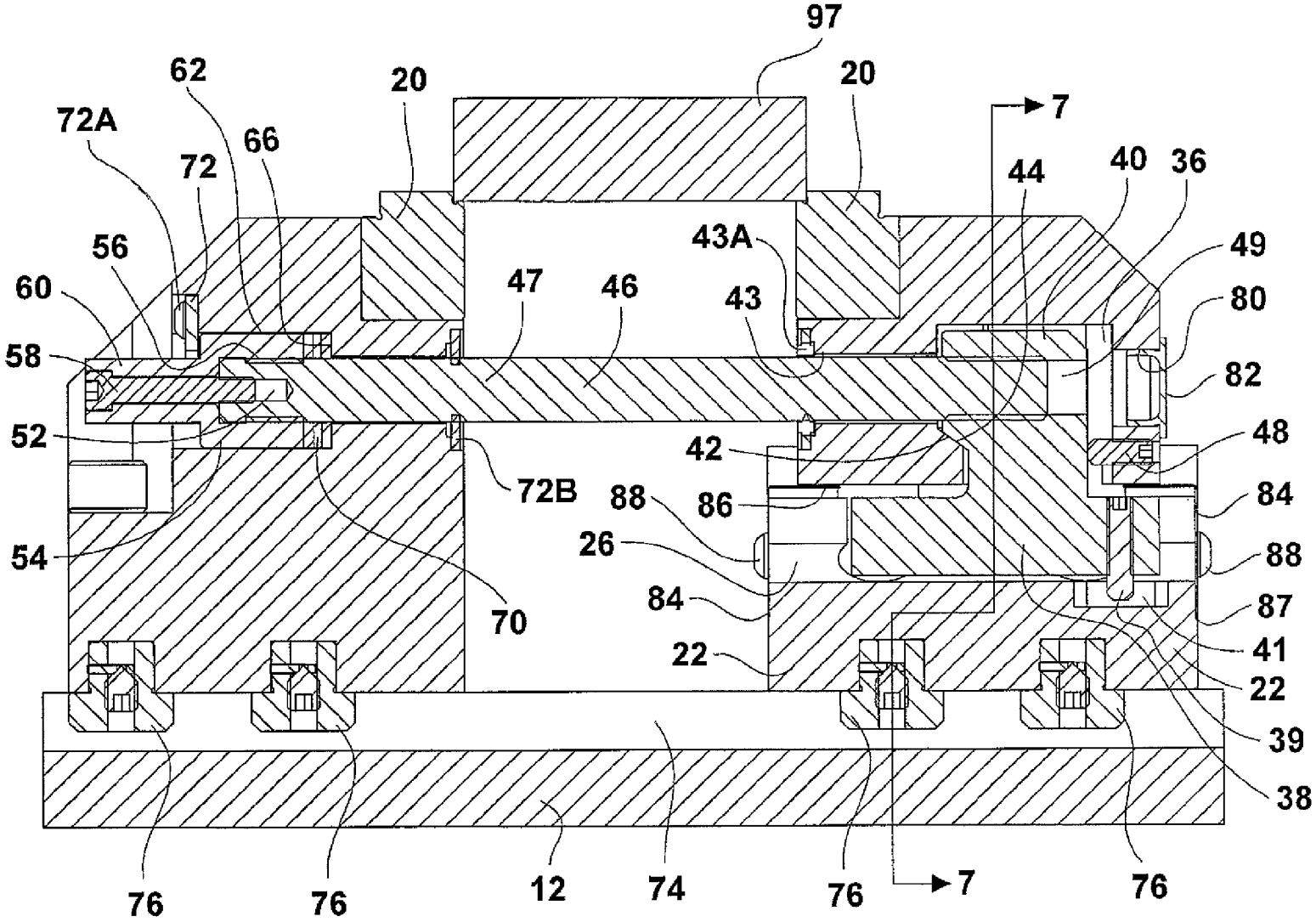
FIG. 6 is a sectional view taken along line 6-6 in FIG. 3.
Figure 7:
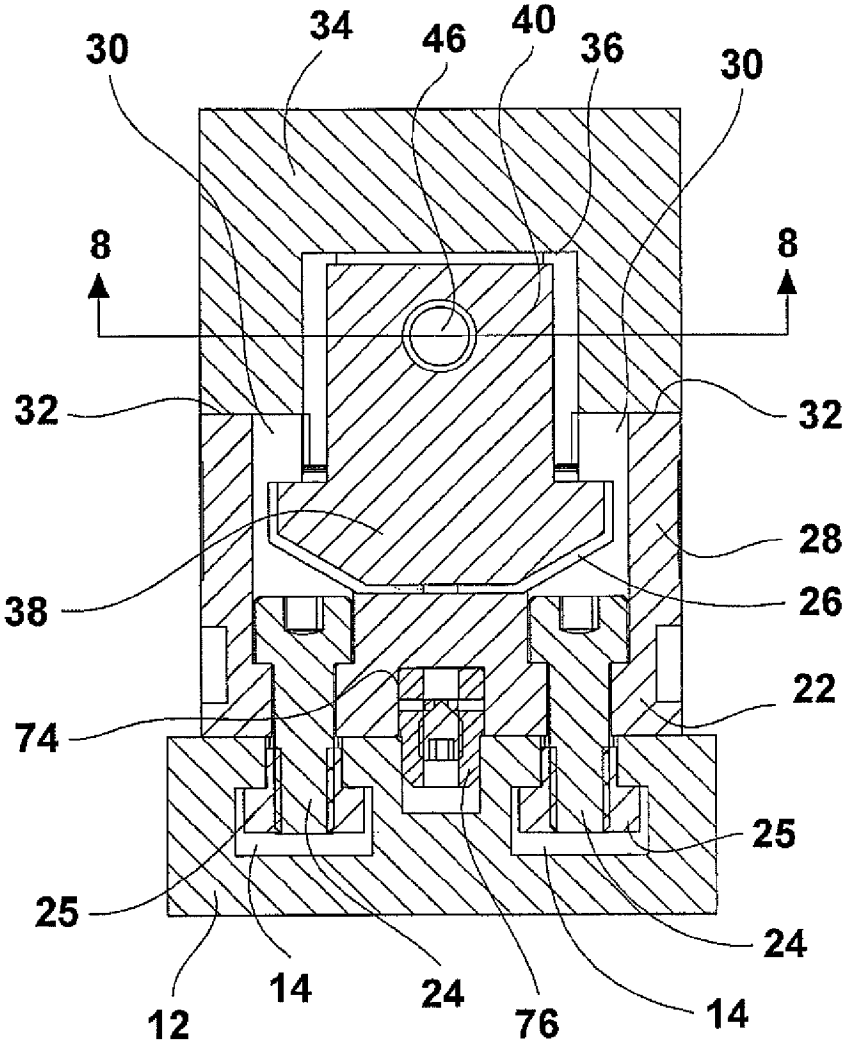
FIG. 7 is a sectional view of the movable nut taken on line 7-7 in FIG. 6.
Figure 8:
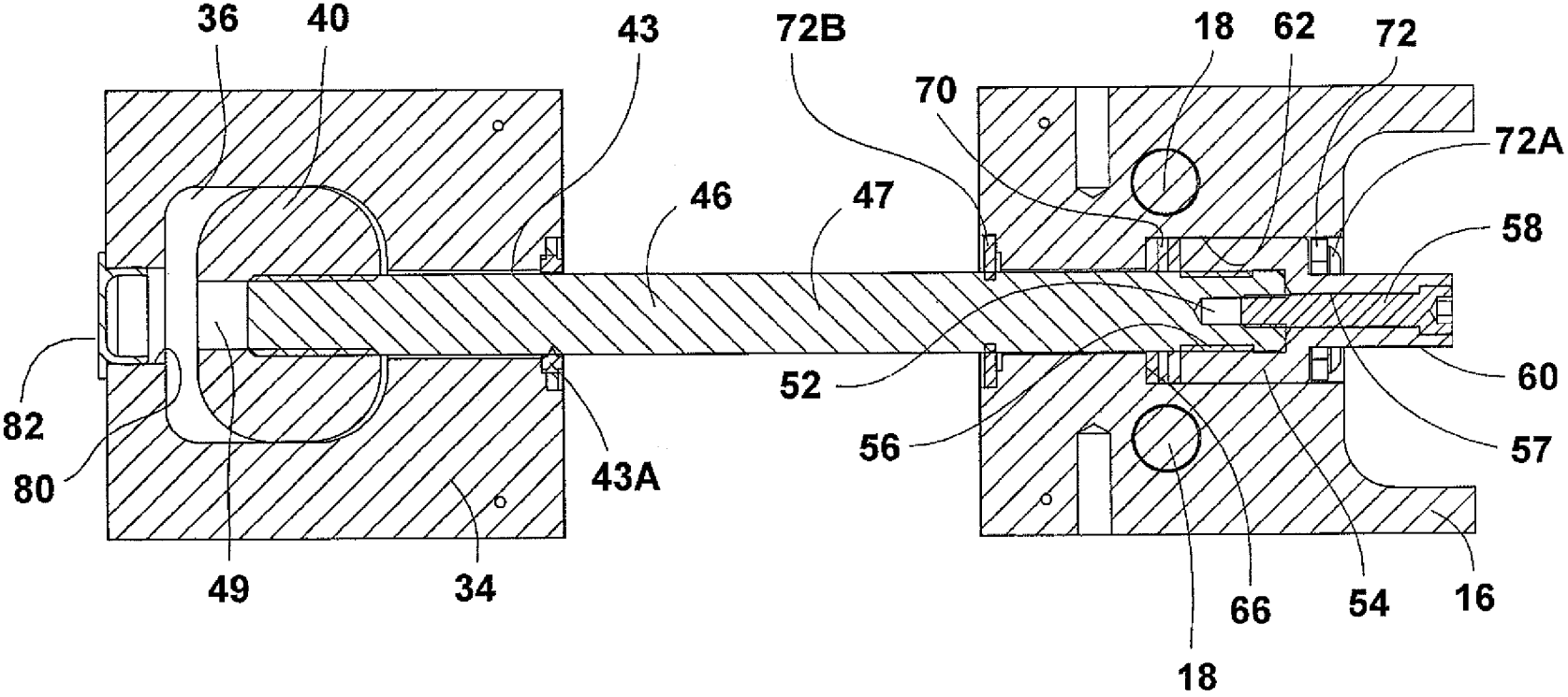
FIG. 8 is a sectional view taken on line 8-8 in FIG. 7.

The screw 46 is preferably made in two parts, as shown in FIGS. 2, 6 and 8 for example. The screw 46 includes a threaded screw shaft 47 having an end portion that threads into an interior bore 56 in a first end of a hub 54. The bore 56 terminates short of the second end of the hub, so there is an end wall having a bore end surface at the inner end of the bore 56. The screw shaft 47 has a threaded internal bore 52 at its drive end. The screw shaft 47 can be threaded and tightened into the bore 56 of the hub to make the screw assembly 46. The screw shaft 47 is tightened and locked in the bore 56 in the hub 54 with a capscrew 58 that extends through a second bore 57 in the second end of the hub 54 that is smaller than bore 56 and which opens to the bore 56. The capscrew 58 is threaded into the bore 52 on the crank end portion 47 of screw 46. The hub 54 has a substantially larger diameter than the screw 46, and rotatably fits into a bore 62 formed in the first vise body portion 16, that supports the fixed jaw of the vise assembly. The hub 54 thus has a large exterior surface area that supports the screw 46 as it is rotated by placing a crank (not shown) on the drive end 60.

The bore 62 of the hub 54 forms a shoulder stop surface 66 that surrounds the screw 46 at an end of the bore 62 adjacent the jaw plate 20, and suitable thrust washers or thrust bearings indicated generally at 70 can be provided between the end of the hub 54 and the shoulder surface 66 to react the load created by tension in the screw 46 as it is tightened to move the movable jaw to clamp a work piece between the jaw plates 20. The hub 54 is rotatably held in the bore 62 with an end plate 72 held with screws 72A, and the screw shaft 47 has a retaining ring 72B that holds it positioned relative to the vise body portion 20. Other suitable retainers can be used.

Figure 5:
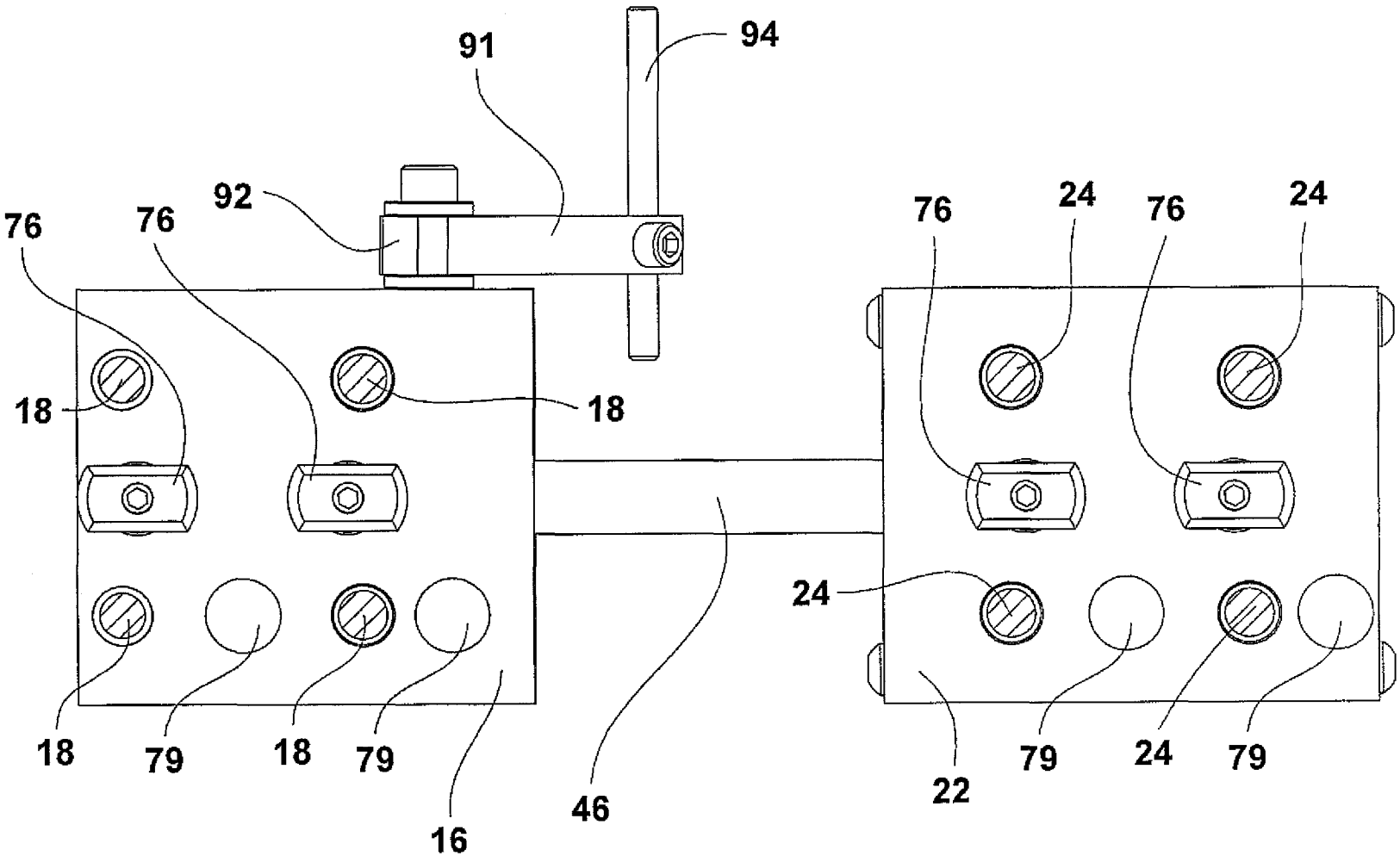
FIG. 5 is a bottom plan view of the two vise body portions of the present disclosure.

In order to maintain the vise body portions suitably aligned, as shown in FIGS. 4 and 5, the vise body portions 16 and 22 are each provided with a pair of locator keys 76 extending down from the bottom surface and positioned to closely fit and slide along a machined groove 74 on top of table 12, centered between the T-slots 14. The locator keys 76 can be retained in place with suitable fasteners, such as set screws. The locator keys 76 fit closely in the grooves 74 on the machine tool table, and have machined sides that precisely locate the vise body portions, and keep them aligned during and after the capscrews 18 and 24 are tightened down to lock the vise body portions in place. Additional locator keys that would slide in the top portions of the T-slots could be mounted in provided openings 79, if desired.

The movable jaw 34 on the vise body portion 22 has a rear bore shown at 80 of size to permit the screw 46 to pass therethrough, if desired. A cap or cover 82 in the bore is provided as well.

Figure 9:
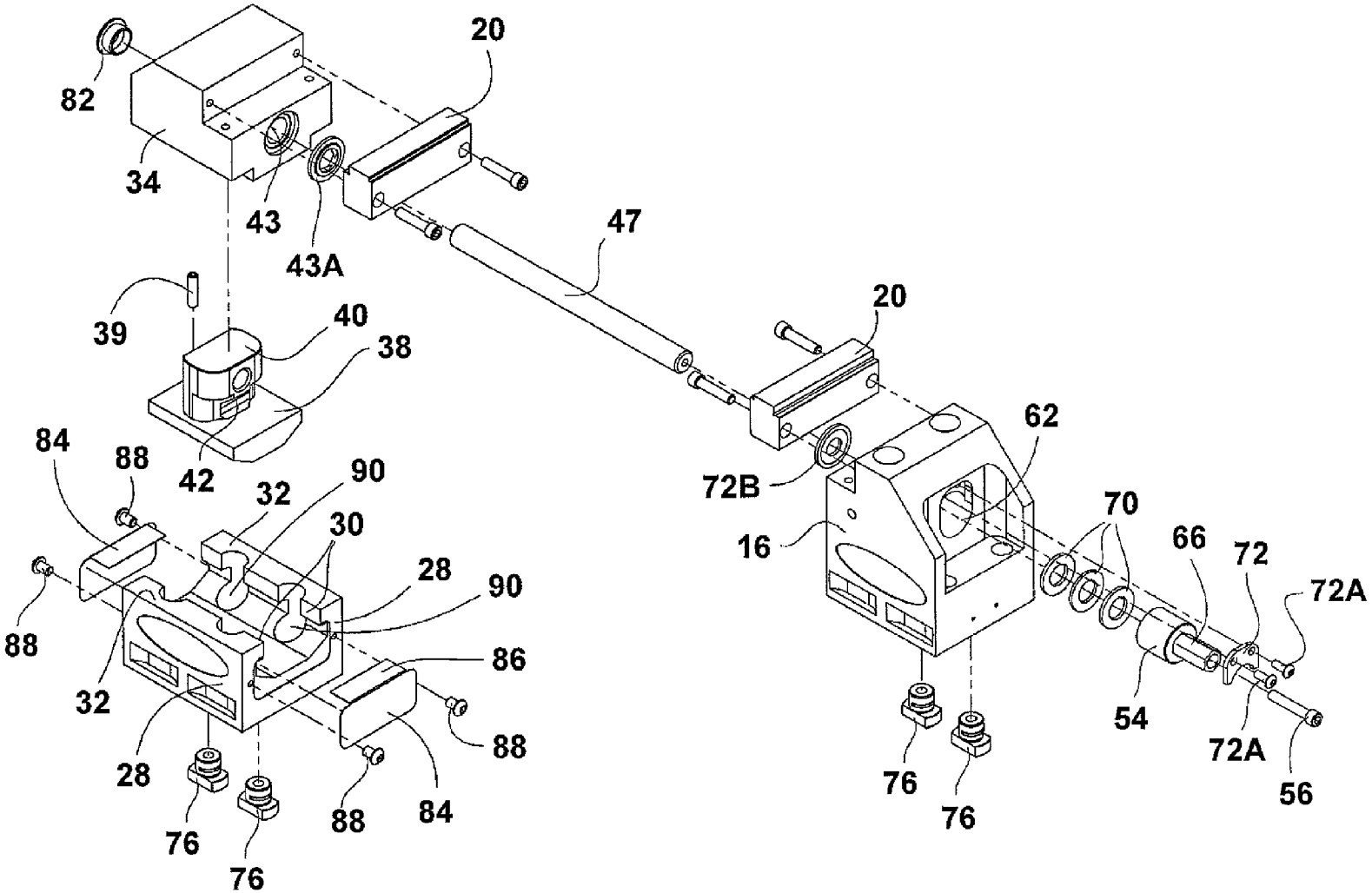
FIG. 9 is an exploded view of the vise assembly.

The open ends of channel 26 in vise body portion 22, and in particular the open end facing the space between the vise body portions, is provided with end chip guards or shields 84, that are held against the ends of the upright walls 28 on the opposite sides of the channel 26. As can be seen in FIG. 9, the exploded view, these chip guards 84 are formed to have a lip or a flange 86 that fits between the rails or lips 30 to overlie end portions of the channel. There is a chip guard at each end of the channel 26. The chip guards can be held in place with screws 88. The chip guards 84 can be put into place after the jaw nut and the movable jaw 34 have been put into the channel 26 and the nut chamber 36.

As stated, there is a stop screw 39 that is threaded through the jaw nut 38 and extends into a slot 41 in the vise body 22, that limits the travel of the movable jaw In FIG. 9, it can also be seen more clearly that the capscrews 24 that hold the second vise body portion 22 in place pass through bores 90 in the bottom wall of the jaw body 22, and are open to the bottom surface of channel 26.

The locator keys 76 are aligned, and positioned so that they will align the jaws of the respective vise body portion precisely along the T-slots 14 of a machine tool table.

A work stop 91, is of conventional design and includes an arm 92 fastened to the side of the first vise body portion 16 with a suitable capscrew, and it includes an adjustable stop rod 94. This work stop can be used as desired for positioning a part properly in the vise jaws prior to tightening the jaws.

In use, for machining a number of parts of the same size and shape, the two vise body portions 16 and 22 can be initially positioned so they provide enough clearance between them to receive the part in the vise jaws, with the movable jaw 34 retracted toward the back of the vise body portion 22. Then, rotating the screw 46 will move the movable jaw 34 to tightly clamp the work piece, such as that shown at 97 in position for machining on several surfaces.

The vise body portions 16 and 22 are spaced above the machine tool table 12 sufficiently so a machine tool spindle and cutter can be inserted below the work piece held in the jaws. There are no obstructions between the vise body portions from the top surface of table 12 to the vise screw 46, which is just under the level of the lower edge of the vise jaws. The screw is raised to provide machining clearance. The vise body portions are made so that there is little deflection of the clamping jaws. One jaw can be moved along support rails on one vise body portion, and since the screw is positioned near the top of the jaw nut, and above the angled surfaces that actuate and clamp the movable jaw 34, there is little deflection of the jaws and a down pressure on the movable jaw reduces the likelihood of upward deflection as the work piece is clamped. Again, the angled surfaces 42 and 44 are inclined relative to the axis of the screw and thus the direction of force, so the down pressure is provided as the movable jaw is tightened, to ensure that there is a down pressure against the surfaces 32 of the rails along which the movable jaw slides when actuated.

The vise body portions 16 and 22 do not deflect while clamping a work piece. The tension carrying member or screw is positioned above the table and above the provided angled surfaces between the movable jaw parts that transfer clamping loads.

The screw 46 is a tension carrying member, and in certain applications, a tension link member can be fixed in the jaw nut 38 in the position shown, and not threaded through the jaw nut. Then, the screw can be slidably mounted in the first vise body portion and actuated with a hydraulic actuator or the like to create a tension in the tension link to pull the movable jaw toward the fixed jaw.

As stated, the vise actuating screw 46 can be of any desired length so that a long work piece can be machined, and still there will be no excessive deflection because of the positioning of the screw on the vise jaw nut to provide a direct force tending to clamp the movable jaw onto the part.

Although the present invention has been described with reference to preferred embodiments, workers skilled in the art will recognize that changes may be made in form and detail without departing from the spirit and scope of the invention.

What is claimed is:

1. A vise assembly for supporting a workpiece above a table comprising first and second separated vise body portions supportable in spaced relation on the table, the first vise body portion having a first workpiece holder and mounting a tension carrying member extending to the second vise body portion, a movable vise jaw mounted on the second vise body portion and having a second workpiece holder facing the first workpiece holder, a jaw nut slidably mounted on the second vise body portion and having a drive surface engaging a mating driven surface on the movable vise jaw, the tension carrying member being coupled to the jaw nut to move the jaw nut drive surface to engage and exert a force on the movable vise jaw driven surface when the tension carrying member is under tension, and the tension carrying member being coupled to the jaw nut at a level below the second workpiece holder and above the drive and driven surfaces.

2. The vise assembly of claim 1 wherein the tension carrying member comprises a screw threadable relative to one of the jaw nut and the first vise body portion.

3. The vise assembly of claim 2 further comprising the screw being threadably engaged to the jaw nut.

4. The vise assembly of claim 1 wherein the drive surface and driven surface are inclined relative to an axis of tension load on the tension carrying member to create a force component urging the movable vise jaw against a support surface for the movable vise jaw on the second vise body portion.

5. The vise assembly of claim 1, wherein the first and second work piece holders have clamping surfaces to support a work piece spaced above the table.

6. A vise screw including a threaded shaft, a hub rotatably mountable on a vise body portion, one end of the threaded shaft being threaded into a first bore in the hub and extending into a first end of the hub and partially through the hub, a second bore in a second end of the hub extending to open to the first bore, a lock screw extending through the second bore in the hub and threaded into a lock bore at the first end of the threaded shaft, a second end portion of the threaded shaft being configured to actuate a movable jaw of a vise assembly including the vise body portion.

7. The vise screw of claim 6 in combination with a vise body portion having a hub bore for rotatably mounting the hub, and a stop surface on the vise body portion to retain the hub in the hub bore when the threaded shaft is under tension.

8. The vise screw of claim 7, further comprising thrust seating members in the hub bore between the hub and the stop surface.

9. A work piece holder for mounting on a machine tool table comprising:

a first vise body having a first jaw, the first vise body being fixable in position on the machine tool table, a second vise body having a second jaw, the second vise body being mountable on the machine tool table at a location spaced from the first vise body and first jaw, said second jaw being movably mounted on the second vise body for movement toward and away the first jaw, the second jaw having a first actuating surface inclined in a direction facing away from the first jaw, a jaw nut slidably mounted on the second vise body portion and having an actuating surface angled to mate with and engage the first actuating surface of the second jaw, and a tension carrying member positioned above the first and second angled actuating surfaces and connected between the first and second vise bodies to exert tension forces to move the second jaw toward the first jaw.

10. The work piece holder of claim 9, wherein the first and second vise body portions are spaced apart on a work table with no obstructions below the tension carrying member.

11. The work piece holder of claim 9, wherein the tension carrying member is a threadable screw rotatably mounted relative to the first vise body portion and threadably mounted in said jaw nut.

12. The work piece holder of claim 9, wherein the first and second jaws are on an opposite side of the tension carrying member from the machine tool table.

13. The work piece holder of claim 9 wherein the first and second vise bodies are configured to support the first and second jaws at a height above the work table sufficient to permit a machine tool to operate below a work piece held in the jaws.

14. The work piece holder of claim 13 further comprising the tension carrying member being adjacent the jaws and spaced from the work table and the sole connection between the first and second vise bodies comprising the tension carrying member.

15. The work piece holder of claim 9, further comprising the second vise body having a channel with a first end open to a space between the first and second vise bodies, and having upwardly facing spaced apart support surfaces on opposite sides of the channel, the jaw nut being slidably mounted in the channel, the second jaw being supported on the upwardly facing support surfaces, and a chip shield mounted on the vise body and covering the first end of the channel to block chips from entering the channel from the space between the vise bodies.

16. The work piece holder of claim 15, further comprising a flange on the chip shield at an upper side thereof extending inwardly to overlie a portion of the channel.

17. The work piece holder of claim 16, wherein the flange on the chip shield is positioned below the tension carrying member.

* * * * *